US005758770A

United States Patent [19]

Moneta

[11] Patent Number: 5,758,770

[45] **Date of Patent: *Jun. 2, 1998**

[54] COMBINED PERSONAL TRANSPORT AND STORAGE CASE FOR A SINGULAR SET OF SKI EQUIPMENT

[76] Inventor: John E. Moneta, 2138 149th Ave. NE., Ham Lake, Minn. 55304

[ * ] Notice: The term of this patent shall not extend beyond the expiration date of Pat. No. Des. 362,115.

[21] Appl. No.: 695,653

[22] Filed: Aug. 12, 1996

Related U.S. Application Data

[63] Continuation-in-part of Ser. No. 40,172, Jun. 12, 1995, Pat. No. Des. 379,870, which is a continuation-in-part of Ser. No. 6,328, Mar. 22, 1993, Pat. No. Des. 362,115.

[51] Int. Cl.[6] ..... B65D 85/00

[52] U.S. Cl. ..... 206/379; D3/261; 206/315.1

[58] Field of Search ..... 206/315.1, 379; D3/261; 190/109; 220/501; 224/328, 917, 917.5

[56] References Cited

U.S. PATENT DOCUMENTS

| | | | |
|---|---|---|---|
| D. 257,913 | 1/1981 | O'Dair . | |
| D. 267,443 | 1/1983 | Salas . | |
| D. 270,495 | 9/1983 | Owings | D3/261 |
| D. 305,831 | 2/1990 | Vanderhorst | D3/261 |
| D. 321,430 | 11/1991 | Wirth . | |
| D. 332,695 | 1/1993 | Moscovitch . | |
| D. 347,322 | 5/1994 | Fiore . | |
| D. 362,115 | 9/1995 | Moneta | D3/261 |
| D. 367,169 | 2/1996 | Vincent . | |
| 3,837,548 | 9/1974 | Nerger | 206/315.1 |
| 3,921,871 | 11/1975 | Heil . | |
| 4,126,254 | 11/1978 | Sahakian . | |
| 4,161,268 | 7/1979 | Heil . | |
| 4,715,416 | 12/1987 | Horne | 206/315.1 |
| 4,953,773 | 9/1990 | Wirth . | |
| 5,012,921 | 5/1991 | Becker . | |
| 5,096,104 | 3/1992 | Wirth . | |
| 5,160,075 | 11/1992 | Moscovitch | 206/315.1 |
| 5,356,013 | 10/1994 | Deioma et al. | 206/315.1 |

*Primary Examiner*—Jimmy G. Foster

[57] ABSTRACT

A substantially rigid combined personal transport and storage case for a single set of ski equipment is configured and to provide at a longitudinal chamber and protruding chamber such that a pair of skis are intended to lie longitudinally in said container and toe portions of a pair of skis boots extend into said protruding chamber to provide a compact combined personal transport and storage case for a single set of ski equipment.

20 Claims, 5 Drawing Sheets

COMBINED PERSONAL TRANSPORT AND STORAGE CASE FOR A SINGULAR SET OF SKI EQUIPMENT

This is a continuation-in-part of a U.S. patent application having Ser. No. 29/040,172, entitled Combined Ski Equipment Transport and Storage Case, filed on Jun. 12, 1995, now U.S. Pat. No. Des. 379870, which is a continuation-in-part of U.S. patent application having Ser. No. 6,328, entitled Combined Ski Equipment Transport and Storage, Case filed on Mar. 22, 1993, now U.S. Pat. No. Des. 362,115.

BACKGROUND OF THE INVENTION

The present invention relates generally to a carrying-type container for ski equipment, and more particularly to a personal transport and storage case for a personal set of ski equipment.

The sport of skiing has developed throughout most of the world, and in areas where it may be practiced to a high degree of popularity and sophistication. While skiing, a typical skier employs, as a minimum, a set of ski equipment comprising a pair of skis, a pair of ski boots, and a pair of ski poles. This equipment, when taken together, is usually cumbersome and difficult to hand carry and transport. Consequently, there exists a need for a singular personal ski equipment case which provides both transporting ease and storage of the ski equipment.

Also, for a typical ski trip, the ski equipment must first be transported from the skier's home by motor vehicle, then hand carried to an airline or other mass transportation luggage check-in and check-out, then hand carried to a destination rental motor vehicle, then transported by the rental motor vehicle to a destination ski area, and then again hand carried to a ski lift or lodging serving the ski area. Consequently, there is a need for an equipment case which is sufficiently rugged to provide ski equipment protection, and which also is light weight, durable, and easily transportable.

As aforesaid, a set of skiing equipment generally includes a pair of skis, a pair of ski boots, and a pair of ski poles. Each ski generally includes a binding for removably attaching a ski boot. Ski boots are generally quite specialized in nature and configuration, and are semi-rigid. Each of the ski poles typically comprises a shaft member having a hand grip at one end and a basket at the shaft's other end. Elongated configurations of the skis and poles, combined with the semi-rigidness of the boots, makes combined transport and storage of a single set of ski equipment difficult.

Various personal ski equipment carriers for some or all of the ski equipment components, both singularly and in combinations, are known in the art. However, in general, ski boots have heretofore been carried in carriers that are separate and distinct from ski carriers, with ski poles sometimes carried in individual containers but more commonly in carriers and cases designed principally for storage and carriage of the skis. These types of carriers do not provide for transport for all of the set of ski equipment components in a single, combined, transport and storage case. Some personal carriers, although combining various ski equipment components together, do not provide protection of the equipment during transport.

Transport carriers also have, heretofore, been developed for containment of multiple sets of ski equipment. These transport carriers have been generally relatively rigid and adapted particularly for motor vehicle rooftop transportation, in turn requiring a receiving rooftop rack type device. However, such containment devices for transporting multiple sets of ski equipment have generally not been configured to provide efficient nor secure containment, nor personal hand carrying of a single set of ski equipment

SUMMARY OF THE INVENTION

An object of the present invention is to provide a combined personal transport and storage case for a singular set of ski equipment which protects the ski equipment during all phases of transportation and storage, and which is easily hand carried.

Another object of the present invention is to provide a case which is transportable by motor vehicle, from airline to ski area, for example, without need on the motor vehicle for a custom carrier system or luggage rack specialized for ski equipment.

In accordance with the present invention, a substantially rigid personal transport and storage case for a single set of ski equipment is provided for providing a complete enclosed container for housing only one pair of skis, one pair of ski poles, and one pair of ski boots, as well other small accompanying ski equipment. The case includes an equipment container having a floor member and a plurality of contiguous wall members forming at least a partially open enclosure. The contiguous wall members extend upwardly from the floor member, and include opposed forward and rearward wall end members and opposed first and second side wall members forming a contiguous walled enclosure. The first and second side wall members substantially define a first longitudinal chamber aligned with a longitudinal reference axis extending along a length of said container and have a length limited by the forward and rearward wall members. The forward and rearward wall end members are aligned substantially transverse to the longitudinal reference axis. Further, the first and second side wall members are generally spaced apart sufficient to permit a pair of skis and ski poles to lie in side-by-side arrangement substantially in parallel with said reference axis. The first side wall member includes a plurality of first side wall member portions to establish a protruding second chamber in communication with the longitudinal chamber and in which the second chamber extends generally perpendicular to and away from said longitudinal reference axis and generally parallel with the floor member. The second chamber is configured to protrude in a direction away from the longitudinal reference axis and at a selected position between the forward and rearward wall members. The second chamber is configured and arranged to accommodate toe portions of a pair of ski boots in which the boots are positioned in the first longitudinal chamber and protruding second chamber with the pair of ski boots being in a mirror-like sole-to-sole and heel-to-heel position adjacency and which their soles are generally perpendicular to the longitudinal reference axis and the floor member; and in which heel portions of the pair of ski boots are adjacent to the second side wall member. The container further includes contiguous container peripheral edge portions defining the open enclosure for mating with peripheral edge portions of a cover. The cover is so constructed to form a protected closed enclosure for set of ski equipment.

Further objects and advantages of the invention may be apparent from the following description wherein details have been presented for completeness of disclosure, without intending to limit the scope of the invention as set forth in the claims below.

DETAILED DESCRIPTION OF THE INVENTION

Figure 1:
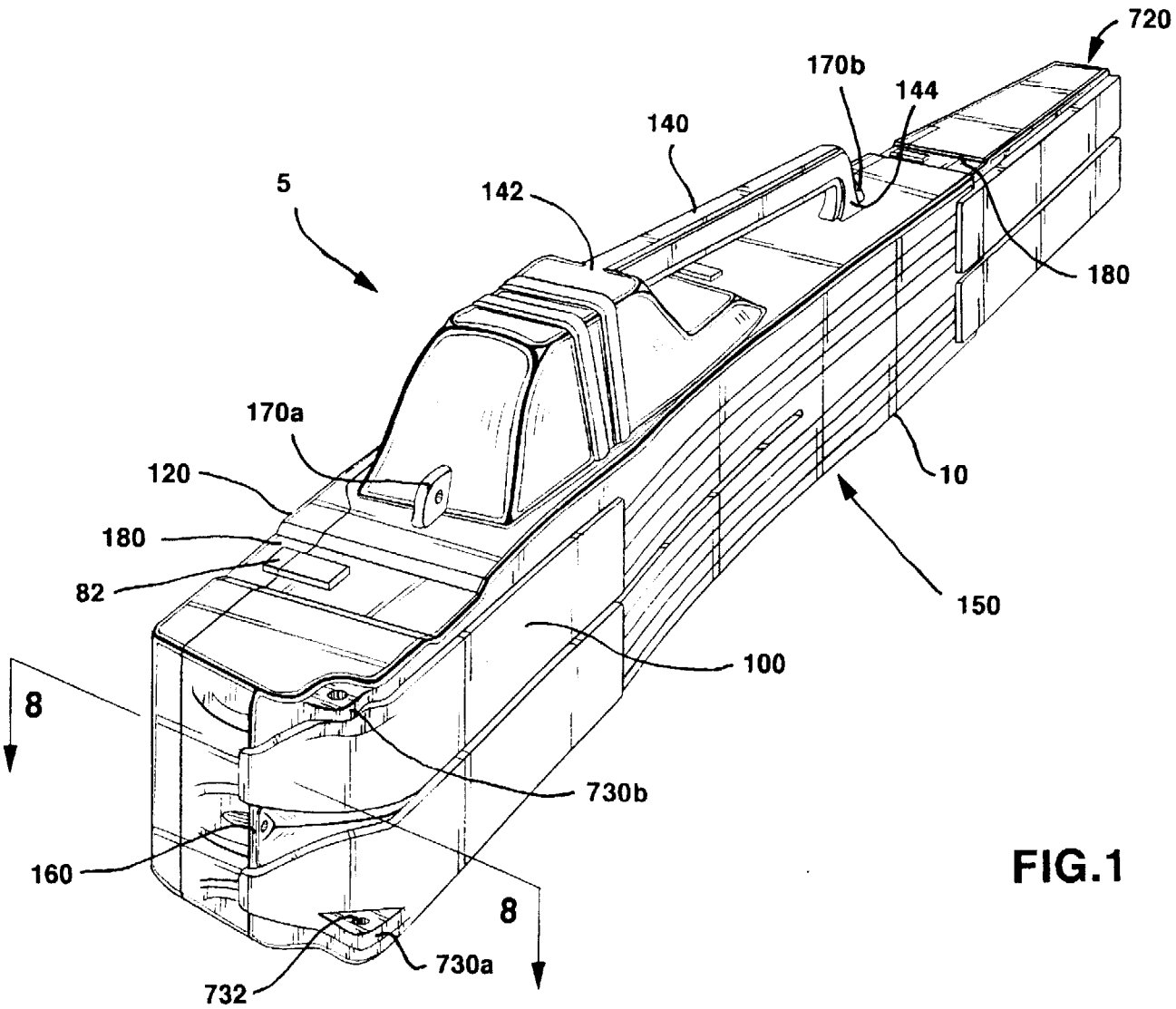
FIG. 1 is a perspective view of the exterior of the combined personal transport and storage case for a single set of ski equipment according to the present invention.
Figure 5:
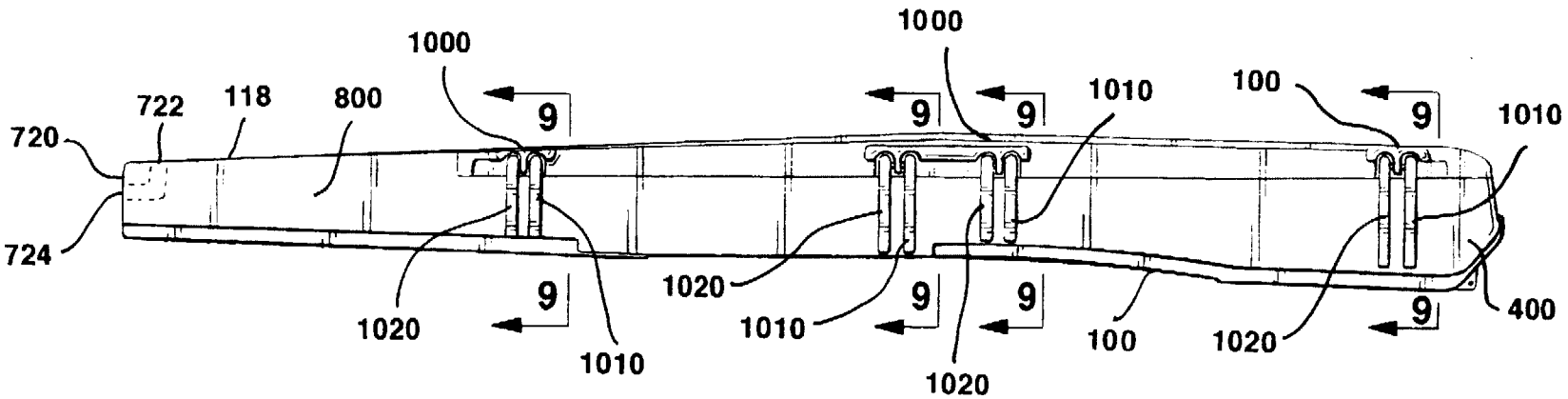
FIG. 5 is a plan view of the case shown in FIG. 1.

Referring to FIG. 1, thereshown is perspective view of a substantially rigid personal transport and storage case 5 for a singular set of ski equipment in accordance with the present invention. Case 5 includes a generally open container 10 and cover 120 secured to container 10 by means of a plurality of latches 82 and hinges 1000 (described later with reference to FIG. 5). Case 5 is intended to be sufficiently large enough to accommodate and enclose a singular set of ski equipment, as particularly illustrated in FIG. 5, including at least a pair of skis 20L and 20R, a pair of ski poles 30, and a pair of ski boots 40L and 40R, as well as other personal equipment (not shown, e.g., goggles, gloves, etc.). Associated with container 10 is carrying handle 140, strap attachment means **170*a* and 170*b* for a shoulder carrying strap (not shown), and automobile attachment means 160., and tow handle 720 and rolling wheels 735 and 737**, particularly illustrated in FIGS. 2 and 8A, respectively.

Referring more particularly to FIGS. 1, 2, 3 and 5, container 10 includes a bottom or floor member 100 and contiguous wall members **110*a–i*. Before proceeding, in the preferred embodiment of the invention, container 10 and cover 120 are intended to be separately constructed by means of plastic molding or the like. Therefore, wall members 110*a–i* and floor member 100** generally form a singular rigid container structure as will be described, and each wall member thereof may be shaped or formed to provide a rigid structure having various aesthetic and/or structural details, for example structural ribs and the like, for rigidity and function not described herein, all of which are within the scope of the accompanying claims.

Figure 2:
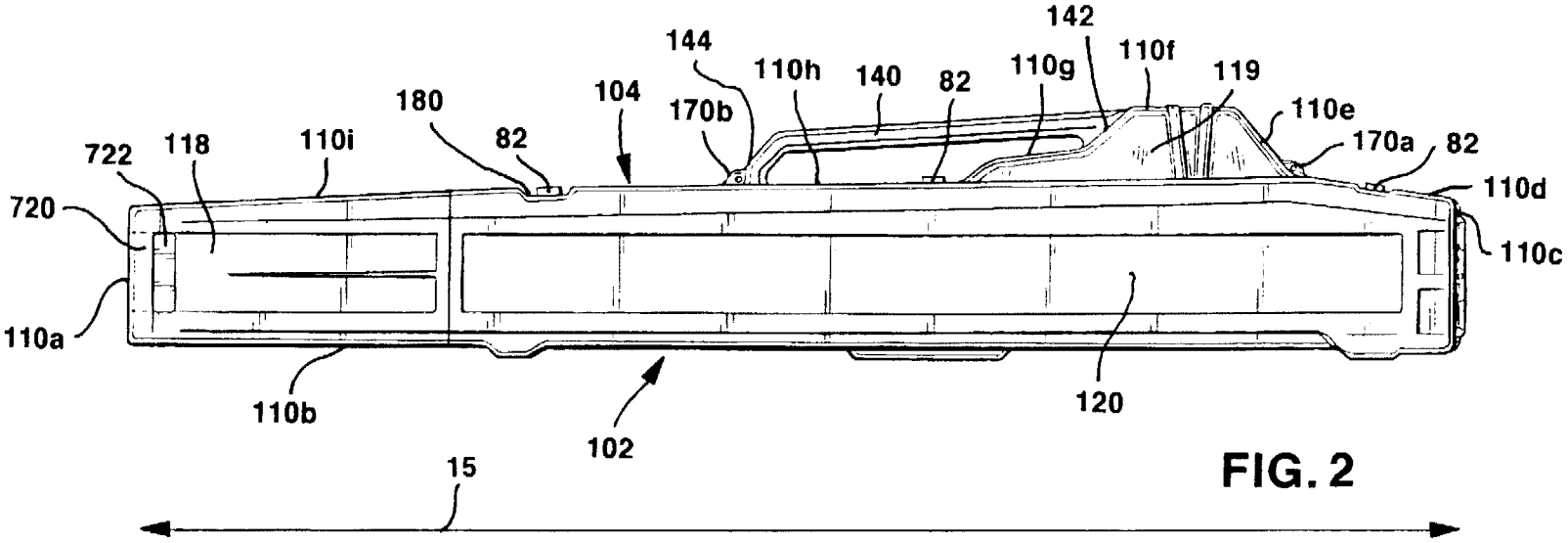
FIG. 2 is a side elevation view of the case shown in FIG. 1.
Figure 3:
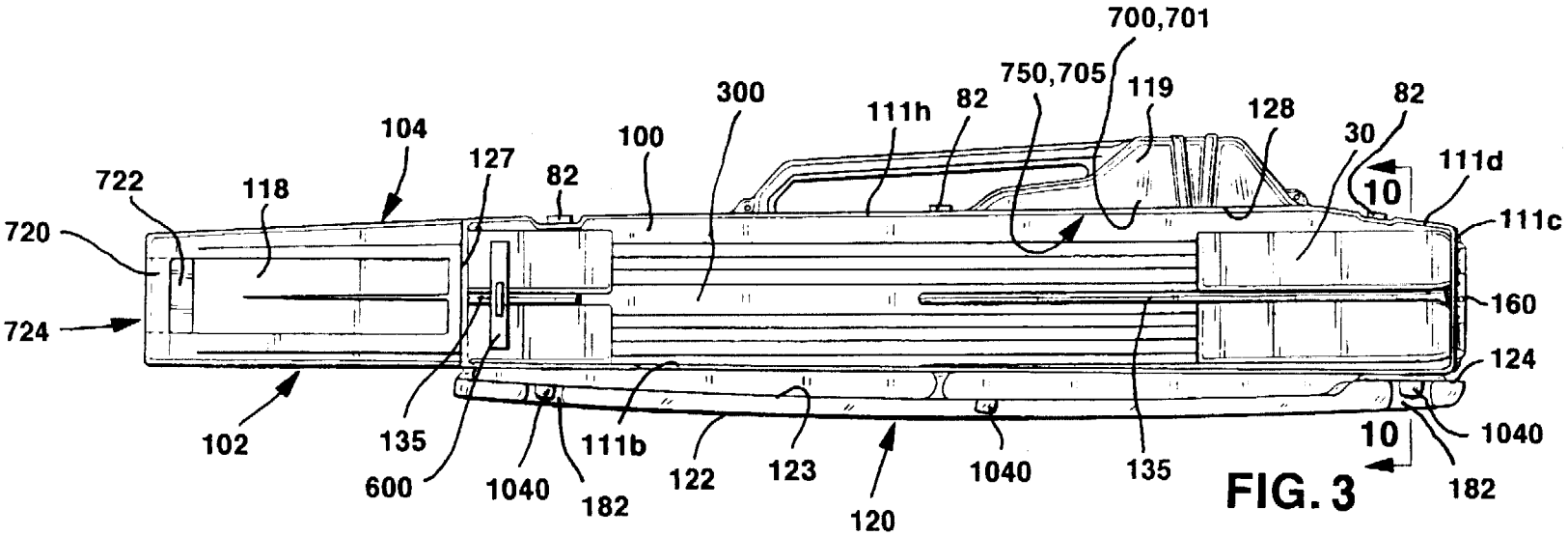
FIG. 3 is a side elevation view of the case shown in FIG. 1 with its cover in an open position, exposing an interior chamber of the case.

FIGS. 2 and 3 illustrate case 10 with cover 120 secured to container 10, and FIG. 3 illustrates case 10 with cover 120 open. Continuing, therefore, wall members **110*a–i* extend generally perpendicular and upwardly from the floor member 100 and generally establishes an open container having cavities or chambers 300 and 700, illustrated in FIG. 3, which are in communication with each other. Wall member 110*b* extends contiguously between opposed rearward end wall member 110*a* and forward end wall member 110*c*. Wall member 110*b* defines a base side identified as side 102 of container 10. A handle side of container 10, identified as side 104, includes contiguous wall members 110*d–i* successively from forward wall member 110*c* to rearward wall member 110*a*. End wall members 110*a* and 100*c* are generally aligned substantially perpendicular to a longitudinal reference axis 15 which generally extends along the length of container 10**.

Contiguous wall members **110*a–i* and floor member 100 generally establishes a longitudinal chamber 300 extending generally from rearward end wall member 110*a* to forward end wall member 110*c*, and which is generally aligned with reference axis 15. Wall members 110*b*, 110*d*, 110*h*, and 110*i* are also generally aligned with reference axis 15**.

Figure 4:
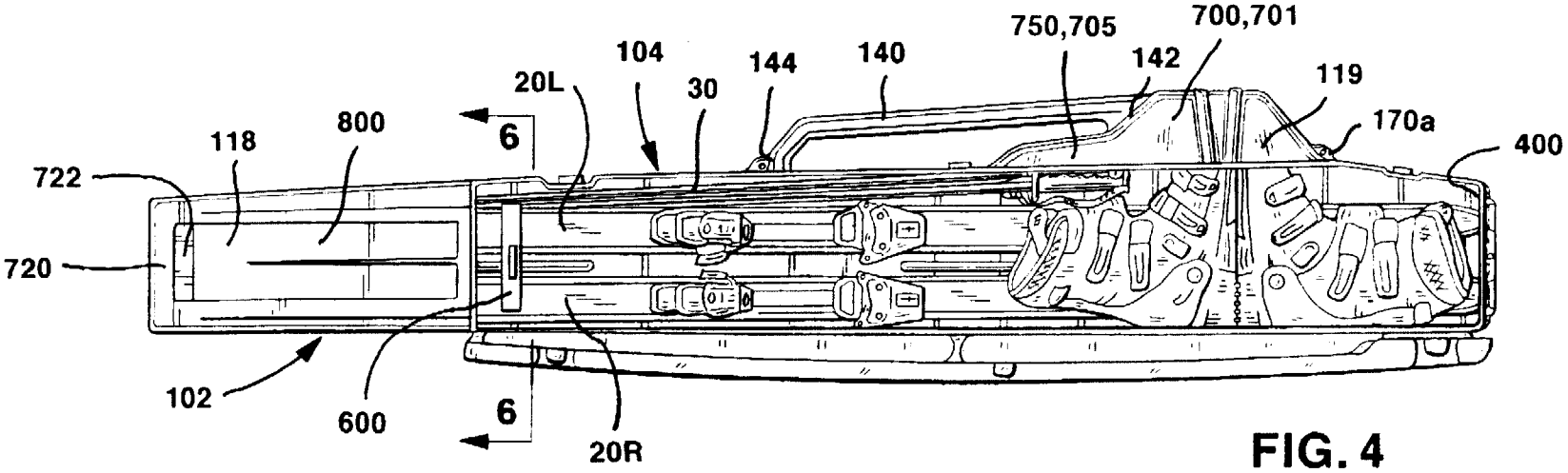
FIG. 4 is a view of the case shown in FIG. 3 with ski equipment placed within the interior chamber.

Referring particularly to FIG. 4, base side 102 and handle side 104 are spaced apart sufficiently to configure chamber 300 to accommodate one pair of skis 20L and 20 R, lying in side-by-side arrangement within chamber 300 with their ski tips proximate forward end wall member **110*c* and pointing away from floor member 100, and one pair of ski poles 30 adjacent to one ski 20L, all of which are generally aligned with reference axis 15. Furthermore, it should be appreciated that base side 102 is intended to rest on a floor with handle side 104** in an upright or carrying position.

Figure 7:
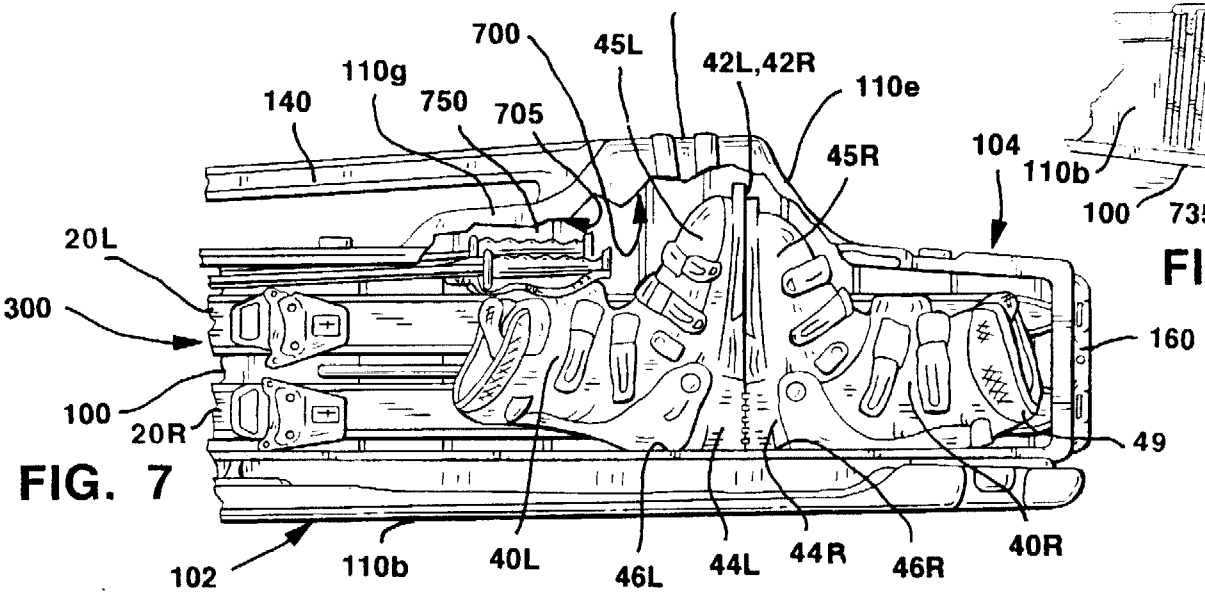
FIG. 7 is an exploded partial interior view of the case shown in FIG. 4.

Referring now more particularly to the exploded partial interior view illustrated in FIG. 7, a second chamber 700 in communication with chamber 300 is substantially established by contiguous wall members **110*e–g*. Wall members 110*e–g* generally form chamber 700 extending generally perpendicular to reference axis 15 and handle side 104 of container 10**.

As illustrated in FIG. 7, a protruding chamber 700 is in communication with chamber 300 as aforesaid with floor member 100 serving as the floor member for both chambers 300 and 700. Chambers 300 and 700 are configured to accommodate one pair of ski boots 40L and 40R in a manner as will now be described with particular reference to FIG. 7. In particular, protruding chamber 700 is configured to accommodate toe portions of a pair of ski boots 40L and 40R which are laying laterally (non-upright) on top of the side-by-side arrangement of skis 20L within chambers 300 and 700 such that their soles are substantially perpendicular to floor 100 and perpendicular side 102 (as well as perpendicular to reference axis 15), and in which their boot bottom surfaces 42L and 42R are in a "mirror like" sole-to-sole and heel-to-heel position adjacency such that their heel members 44L and 44R are in a heel-to-heel arrangement and their toe portions 45L and 45R are in a toe-to-toe arrangement. Chamber 700, protruding from container 10, is configured to be generally in a direction perpendicular to reference axis 15 to accommodate toe portions 45R and 45L of each boot 40L and 40R when such boots are placed within container 10 as afore described with the backside of their heel members 46L and 46R being generally adjacent to wall member **110*b* and with the "foot insertion end" or "leg cuff end" 49 of boot 40R proximate to forward end wall member 110*c* and within the chamber generally formed by wall members 110*b*, 110*c*, and 110*d***

Referring again to FIGS. 1, 2, 3, and 4, container 10 also includes a rear cover member 118, toe cover member 119, and hinged cover member 120. FIG. 2 illustrates case 5 with chambers 300 and 700 fully covered, and FIG. 3 illustrates case 10 with hinged cover member 120 in the open position. In the preferred embodiment of the invention, rear cover member 118 is integral with and extends between wall members **110*a*, 110*b*, and 110*i*; and toe cover member 119 is integral with and extends generally between wall members 110***e*, 100*f*, and 110*g* and generally covers chamber 700. Hinged cover member 120 as illustrated in the preferred embodiment of the invention covers those portions of chambers 300 and 700 not covered by rear cover member 118 and toe cover member 119.

In the preferred embodiment of the invention, a ski rear-end pocket 800 is formed by end member 110*a*, a portion of wall members 110*b* and 110*i*, rear cover member 118, and a portion of floor member 100. Similarly a boot-toe pocket 701 is formed by portions of contiguous wall members 110*e*, 110*f*, and 110*g*, toe cover member 119, and a portion of floor member 100.

Referring more particularly to FIG. 3, cover member 120 generally includes a top surface 122 and a bottom surface 123 which generally forms a peripheral bottom edge 124. In the preferred embodiment of the invention, wall members 10*b*, 110*c*, 110*d* and 110*h* include contiguous contoured edge members 111*b*, 111*c*, 111*d*, and 111*h* configured for mating with complementary portions of peripheral bottom edge 124 of cover 120. Furthermore, exposed edge members 127 and 128 of cover members 118 and 119, respectively, are also contoured to receive complementary portions of peripheral bottom edge member 124 of cover 120.

Cover 120 and container 10, having aforesaid mating contoured edge members 111*b*, 111*c*, 111*d*, 111*h*, 127 and 128, are of course intended to provide a complete enclosure of any equipment within chambers 300 and 700 and associated pockets 800 and 701. A mating arrangement or closed relationship of the aforesaid edge members with peripheral edge member 124 of cover 120 may be provided by a wide variety of mating techniques including tongue-and-grove, as well as edge-lip combinations. In the preferred embodiment of the invention, it is preferable that the entire peripheral edge 124 of cover 120 rests on contoured container edge members, as aforesaid, to support cover 120 from any downward movement of cover toward floor member 100 when in the covered position. The mating relationship of cover 120 and container 10 is intended to provide an enclosed or protected enclosure for the personal ski equipment set.

It will be appreciated by those skilled in the general art of case or container construction that container 10 of the present invention may be practiced by means of thermoplastic molding to create the afore described components. Other suitable construction methods, for example, may incorporate fiberglass or aluminum.

Figure 6:
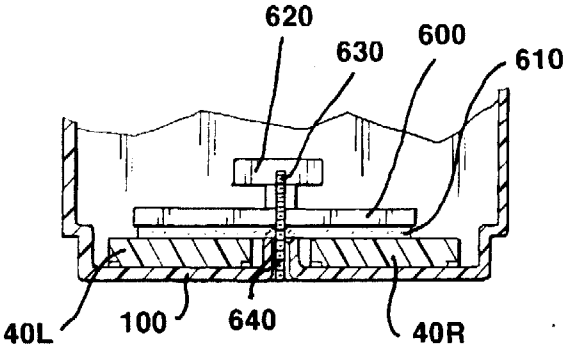
FIG. 6 is a partial cross-sectional view taken along lines 6—6 of FIG. 4.

As particularly illustrated in FIG. 3, 4 and 6, the pair of skis may be held in place by bar member 600 having a resilient foam member 610. Bar member 600 may be held in place as exemplary shown in FIG. 6 by means of a knob 620 having a threaded screw member 630 affixed thereto. In turn, screw member 630 may be screw to a receiving nut member 640 embedded and affixed to floor member 100. Of course, bar member 600, or the like, may be provided by other means as shown for more tenaciously securing the skis to floor member 100.

In accordance with the present invention, chamber may be configured to include an elongated extension chamber 750 formed particularly by contoured wall member 110*g* extending between wall members 110*f* and 110*h* as particularly illustrated in FIG. 7 for creating a pocket 705 for housing the handles of ski poles 30.

As particularly illustrated in FIG. 3, bottom member 100 may include at least one ski rib member 135 which longitudinally extends or protrudes in part outwardly from the bottom member 100, with rib member 135 generally aligned with reference axis 15. Rib member 135 is also intended to provide a distinguishable ski chamber within chamber 300 such that skis 20*a*–*b*, when placed within chamber 300 and within confines of rib member 135, are maintained in a protective spaced apart arrangement from each other.

Figure 11:
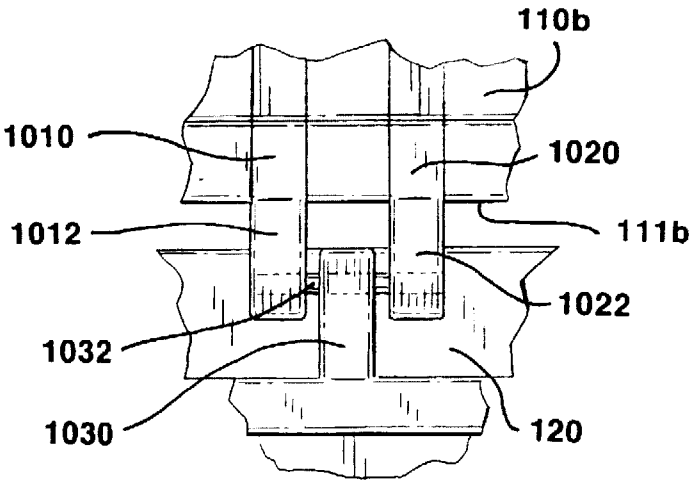
FIG. 11 is an exploded cross-sectional view, taken along the lines 11—11 of FIG. 10.
Figure 9:
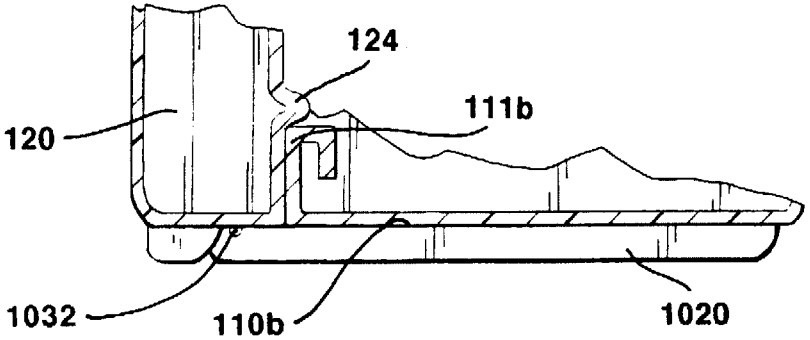
FIG. 9 is a cross-sectional view, taken along the lines 9—9 of FIG. 5 illustrating a closed cover.
Figure 10:
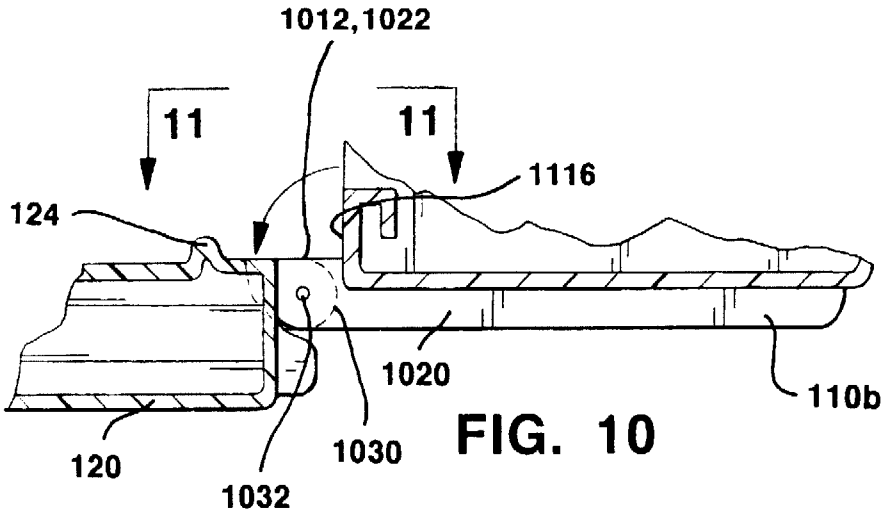
FIG. 10 is a cross-sectional view, taken along lines 10—10 of FIG. 3 illustrating an open cover.

Referring now particularly to FIGS. 3, 5, 9, 10, and 11, thereshown are plurality of hinges 1000 for securing cover 120 to container 10, one of which is particularly illustrated in FIG. 11. In the preferred embodiment of the invention, each of the hinges 1000 includes of a pair of spaced apart finger members 1010 and 1020 formed in and integral with wall member 110*b*. Finger members 1010 and 1020 additionally serve as strengthening ribs serving as a standing base for base side 102. Fingers 1010 and 1020 include ears 1012 and 1022 extending away from edge member 111*b* of wall member 110*b*. Cover 120 includes a mating hinge member 1030 integral therewith and configured to mate with and be interposed between ear members 1012 and 1022 as shown particularly in FIG. 11. Ear members 1012 and 1022, and hinge member 1030 include aligned apertures for receiving a hinge pin 1032 secured in place. Other hinge arrangements, including those having separate components not formed as part of case 10 and cover 20 and attached thereto, serving the same intended function are of course well known in the art, and are intended to be within the scope of the present invention.

Container 10 further includes a plurality of latches 82 for latching handle side 104 to a latch side of cover 120 opposite the hinge side thereof. Like hinges 1000, latches 82 may be provided by any of a number of well-known latching arrangements. In the preferred embodiment of the invention, a latching tab 1040, illustrated in FIG. 3, is formed as part of cover 120, and mechanical latch mechanisms 82 are fastened, by any means, to handle side 104 wall members as illustrated.

When container 10 is used during travel, and especially during airline transportation which typically subjects transported articles to high stresses and strains, a need may arise to additionally secure cover 120 to container 10. That is, the high stresses and strains could cause even high-strength hinges 1000 and latches 82 to fail, thereby allowing the cover 120 to come open. For this possibility, channels 180 and 182 are formed within portions of both container 100 and cover 120, respectively, as particularly illustrated in FIGS. 2 and 3, as to permit for fastening straps (not shown) thereabout. These straps would then form a plurality of loops with cover 120 within the loops, thereby securing the cover 120 to container 10.

Ski end pocket 800 is configured and arranged to accommodate a pair of ski pole tips and baskets, and ends of a pair of skis as is generally depicted in FIG. 4. Specifically, handles of the ski poles would be bounded, at least partially, by chamber 705 and corresponding pocket 750 at one end, and the ski pole basket tips by pocket 800.

In the preferred embodiment of the invention, container 10 also includes a handle 140 integral with side 104 wall members 110*h*, 110*g*, and 110*f* to provide easy hand carrying of case 5. Handle 140, as depicted in the drawings, includes opposed handle end members 142 and 144, respectively. Handle end member 142 is in fixed arrangement with a portion of wall member 110*g*. Opposite handle end member 144 is in fixed arrangement with a portion of wall member 110*h* at a position toward rear end member 110*a*. The configuration of handle 140 and its location is generally chosen to provide a generally balanced unit when case 5 is housing a singular set of ski equipment. Preferably, handle 140 is constructed to be integral with wall members 110*h* and 110*g* in a manner as already described. However, handle 140 may alternatively be embodied by a strap attached in the same proximity as handle ends 142 and 144, or rigid handle member affixed to container 100.

By choice of appropriate plastic molding techniques, container 10 may be designed to incorporate further aspects of the present invention as will now be described.

DRAG-HANDLE & WHEELS

As particularly illustrated in FIGS. 2, 3, 4, and 5, a drag-handle bar member 720 may be molded into end member 110*a* in combination with cover member 118. As illustrated, cover member 118 includes an aperture 722 in communication with an aperture 724 formed in end member 110*a* so as to provide a drag-handle bar member 720. These apertures, of course, are formed in container 10 so as to be in non-communication with chamber 300 so that pocket 800 is fully enclosed from the external environment—i.e., contains appropriate contiguous wall members.

Figure 8:
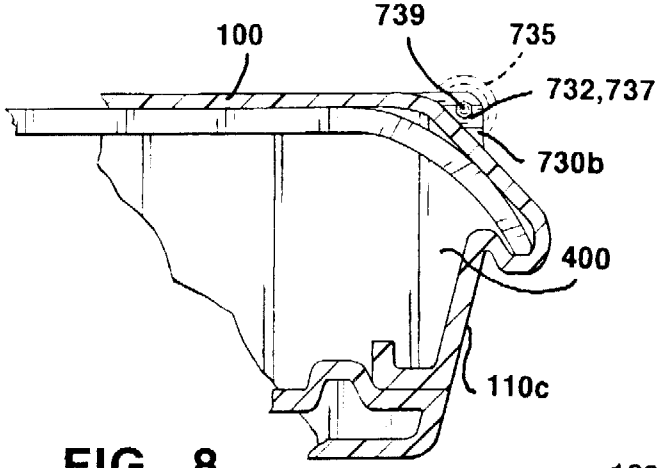
FIG. 8 is an exploded cross-sectional view, taken along the lines 8—8 of FIG. 1
Figure 8A:
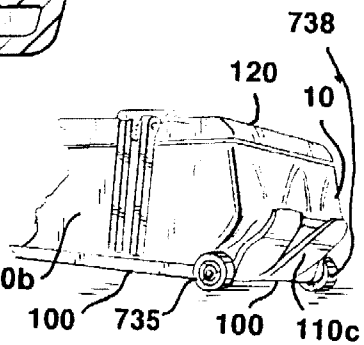
FIG. 8A is a perspective view of the forward end of the case in accordance with one aspect of the present invention.

As particularly illustrated in FIGS. 1, 8, and FIG. 8A, wall member 110*c* may include tabs or protrusions 730*a* and 730*b* formed, at least in part, on base side 102 with contiguous wall members 110*b* and 110*c*, and floor member 100, and on the handle side 104 with contiguous wall members 110*d* and 110*c*, and floor member 100. Protrusions 730*a–b* are provided with an aperture 732 for receiving an axle 737 held on by a fastening nut 739 for holding a pair of wheels 735 and 737. Each wheel may be held in place by an axle on each end, or axle passing through the both protruding tabs 730*a* and 730*b*. This arrangement of wheels may be made a permanent attachment, or alternatively may be configured to be easily removed and attached as desired. With the arrangement as just described, case 5 may be transported by grabbing the grab-handle and dragging case 5 on wheels 735 and 738.

CONCAVE FLOOR MEMBER

In one embodiment of the invention as illustrated in FIG. 1, floor member 100 also includes a concave portion 150 between the rearward and forward end wall members 110*a* and 110*c*, respectively. Concave portion 150 is configured to somewhat mate with a convex rooftop of a motor vehicle. It is desirable, when case 5 is in juxtaposition with a motor vehicle rooftop as aforesaid, scratching of the rooftop could arise from direct contact of case 5 with the rooftop. To this end, an added feature of case 5 may include interposing a non-scratching material between case 5, and more particularly the external side of floor member 100 and the rooftop. Accordingly, floor member 100 may have affixed thereto a soft material, such as any widely available self-adhesive foam strips to prevent scratching of the rooftop.

SKI-TIP FORMATIONS

Further illustrated in FIG. 1, forward end member wall contiguous and integral with floor member 100 is configured to provide "ski-tip" internal cavities and external appearance as particularly illustrated in FIGS. 1 and 8. Further, wall member 110*c* may be further configured to provide a strap attachment means 160, particularly illustrated in FIGS. 1 and 7, and thereby permit case 5 to be secured to a motor vehicle rooftop in secured arrangement by means of a strap (not shown) connected to a front or rear automobile end member (not shown) and to strap attachment means 160, and a strap affixed to grab-handle member 720 strapped to the opposite end of the automobile.

CARRYING STRAP

Further illustrated are forward and rearward shoulder strap attachment means 170*a–b*. Rearward shoulder strap attachment point 170*b* is illustrated as a protrusion from container 10 having an aperture therethrough and located at the intersection of handle end member 144 and wall member 110*h*. Forward shoulder strap attachment point 170*a* is illustrated as a protrusion from container 10 having an aperture therethrough and located at the apex formed by wall members 110*d* and 110*e*. Shoulder strap attachment points 170*a–b* permit fastening of a shoulder strap thereto (not shown), thereby permitting the case to be easily carried by a user's shoulder by means of a weight bearing strap.

Thus, according to the preferred embodiment of the invention there has been described a combined personal transport carrier and storage case 5 for a single set of ski equipment including a longitudinal chamber 300 and a protruding chamber 700 transverse to the longitudinal direction particularly aligned with reference axis 15. Chamber 700 is covered in part to form a boot-toe pocket 701, a ski pole handle pocket 750. The rear end portion of chamber 300 is partially covered to form a ski-end pocket 800. Container 10 is loaded by inserting the ski ends into pocket 800 laying in juxtaposition with floor member 100 in side-by-side arrangement. In turn, the ski boots are positioned in the container 10 by first inserting one boot 44R with the toe portion 45R inserted into chamber 700 and pocket 701, and cuff portion thereof tucked near wall member 110*c*, and the heel portion 44R adjacent wall member 110*b*. The second boot 40L is positioned in container 10 by inserting toe portion 45L inserted into chamber 700 with sole 42L thereof opposite sole 42R in mirrored arrangement. In turn, the ski pole tips of ski poles 30 are first inserted into pocket 800 aligned with reference axis 15, the handles tucked into chamber 705 and corresponding pocket 750 thereof, in proximity to the instep of boot 40L and chamber 700 and corresponding pocket 701.

The foregoing description of the invention is necessarily detailed so as to provide understanding of the invention's best mode of practice. It is to be understood, however, that various modifications of detail, rearrangement, addition, and deletion of components may be undertaken without departing from the invention's spirit, scope, or essence.

I claim:

1. A substantially rigid personal transport and storage case for a single set of ski equipment including at least a pair of skis, each having a curved ski tip end and a rearward ski end, a pair of ski poles, each having a handle end and a pole basket end, and a pair of ski boots, each having a sole, a heel, a toe end, and a leg cuff end, said rigid personal transport and storage case comprising:

an equipment container having a container floor member and a plurality of contiguous wall members forming at least a partially open enclosure, said contiguous wall members extending upwardly from said floor member, said wall members including opposed forward and rearward wall end members and opposing first and second side wall members forming a contiguous walled enclosure, said first and second side wall members substantially defining a first longitudinal chamber aligned with a longitudinal reference axis extending along a length of said container and having a length limited by said forward and rearward wall members, and said forward and rearward wall end members being aligned substantially transverse to said longitudinal reference axis, and wherein, said second side wall member and portions of said first side wall member being generally aligned with said longitudinal reference axis and spaced apart to (i) permit a pair of skis to lie on said container floor member in side-by-side arrangement substantially in parallel with said reference axis with said curved ski tip ends of said pair of skis proximate to said forward wall member and extending away from said container floor member, and said first side wall member includes a plurality of first side wall member portions for establishing a second chamber in communication with said longitudinal chamber and in which said second chamber extends generally perpendicular to said longitudinal reference axis and having a floor member generally formed, at least in part, by said container floor member, said second chamber protruding away from said longitudinal axis at a selected position between said forward and rearward wall members, and in which said second chamber is configured and arranged to accommodate toe portions of a pair of ski boots positioned in said first and second chambers with said pair of skis being between said container floor member and said pair of ski boots, and said pair of ski boots being in a mirror-like sole-to-sole and heel-to-heel position adjacency, and which the soles are generally perpendicular to said reference axis and said container floor member, and in which the heel portions of said pair of ski boots are bounded by and proximate to said second side wall member, and in which said leg cuff end of one of said pair of ski boots is proximate to said forward wall end member, and said container including contiguous peripheral container edge portions defining said open enclosure; and a cover having opposite top and bottom sides, said bottom side including peripheral bottom edge portions configured such that said peripheral bottom edge portions may be placed in mating relationship with said contiguous peripheral container edge portions, with said cover further configured such that said equipment container and said cover form a protected closed enclosure for said set of ski equipment.

2. The transport and storage case of claim 1 wherein said container floor member includes at least one ski rib member extending in part outwardly from said container floor member and aligned substantially in parallel with said longitudinal reference axis to provide a distinguishable ski chamber such that said skis are maintained in a protective spaced apart arrangement.

3. The transport and storage case of claim 1 further comprising a handle means, integral with said first side member having opposed first and second handle end members wherein said first handle end member is in fixed arrangement with those portions of said first side wall member forming said second chamber, and said second handle end member is in fixed arrangement with said first side wall member between said rearward end and said second chamber such that said case may be hand carried.

4. The transport and storage case of claim 1 wherein said container floor member includes a concave contoured portion thereof between said forward and rearward end members for accommodating a similarly contoured motor vehicle rooftop.

5. The transport and storage case of claim 1 wherein said forward end member includes a means for fastening a strap thereto for permitting said case to be secured to said motor vehicle rooftop in a secured arrangement.

6. The transport and storage case of claim 1 wherein said first side wall member includes forward and rearward attachment points on opposite sides of said second chamber for fastening a shoulder strap thereto, and for permitting said case to be carried by a user's shoulder.

7. The transport and storage case of claim 1 further comprising means for securing said cover to said equipment container.

8. The transport and storage case of claim 7 further where in said cover is secured to said second side wall member in a hinged arrangement.

9. The transport and storage case of claim 8 where in said cover includes hinge members integral therewith and adapted to mate with mating hinge members integral with said second side wall member.

10. The transport and storage case of claim 9 where in said cover includes latch members integral therewith and opposite said hinge side thereof, and adapted to mate with mating latch members secured to said first side wall member.

11. The transport and storage case of claim 1 wherein said first side wall member provides a third chamber in communication with said first and second chambers and generally forming a small protruding chamber of sufficient size and arrangement to accommodate a pair of ski pole handles, with said ski poles handles bounded at least partially by said third chamber, and with basket ends of the ski poles lying within said longitudinal chamber and pointing toward said rearward end member.

12. The transport and storage case of claim 1 further comprising a first cover member integral with portions of said first and second side wall members and said rearward wall member, extending toward said forward wall member so as to form a first rearward pocket so as to be capable of covering, at least in part, rearward ski ends of said pair of skis when positioned within said transport and storage case.

13. The transport and storage case of claim 13 further comprising a second cover member integral with portions of selected ones of said plurality of first side wall member portions establishing said second chamber and extending over, at least in part, said second chamber so as to form a boot-toe pocket.

14. The transport and storage case of claim 1 further comprising a cover member integral with said plurality of first side wall member portions of said first side wall member and extending substantially over said second chamber so as to form a boot-toe pocket.

15. The transport and storage case of claim 1 further comprising a handle bar member formed integral with said rearward end wall member.

16. The transport and storage case of claim 15 further comprising means for affixing a pair of wheels to said container.

17. The transport and storage case of claim 1 further comprising means for affixing a pair of wheels to said container.

18. A substantially rigid combined personal transport and storage case for a single set of ski equipment including at least a pair of skis, each having a curved ski tip end and a rearward ski end, a pair of ski poles, each having a handle end and a pole basket end, and a pair of ski boots, each having a sole, a heel, a toe end, and a leg cuff end, said rigid personal transport and storage case comprising:

a container for forming at least a partially open ended enclosure having, a longitudinal chamber, having a forward end portion, a rearward end portion, and a container floor member opposite an open end thereof, and configured and arranged for housing a pair of skis in side-by-side arrangement substantially in parallel with a reference axis and with said curved ski tip ends of said pair of skis proximate said forward end portion and extending away from said container floor member, a protruding chamber extending away from said longitudinal chamber, said protruding chamber configured and arranged to accommodate toe portions of a pair of ski boots positioned within said container with said pair of skis being between said container floor member and said pair of ski boots, and said pair of ski boots being in a mirror-like sole-to sole and heel-to-heel position adjacency, and which the soles are generally perpendicular to said reference axis and said container floor member, and in which the heel portions of said pair of ski boots are bounded by and proximate to peripheral portions of said container, and in which said leg cuff end of one of said pair of ski boots is proximate said forward end portion, and said container including contiguous peripheral container edge portions defining said open enclosure; and a cover for covering said open ended enclosure, said cover having opposite top and bottom sides, said bottom side including peripheral bottom edge portions configured such that said peripheral bottom edge portions may be placed in mating relationship with said contiguous peripheral container edge portions, with said cover further configured such that said equipment container and said cover form a protected closed enclosure for said set of ski equipment.

19. A substantially rigid personal transport and storage case for a single set of ski equipment including at least a pair of skis, each having a curved ski tip end and a rearward ski end, a pair of ski poles, each having a handle end and a pole basket end, and a pair of ski boots, each having a sole, a heel, a toe end, and a leg cuff end, said rigid personal transport and storage case comprising:

an equipment container having a container floor member and a plurality of contiguous wall members forming at least a partially open enclosure, said contiguous wall members extending upwardly from said floor member, said wall members including opposed forward and rearward wall end members and opposing first and second side wall members forming a contiguous walled enclosure, said first and second side wall members substantially defining a first longitudinal chamber aligned with a longitudinal reference axis extending along a length of said container and having a length limited by said forward and rearward wall members, and said forward and rearward wall end members being aligned substantially transverse to said longitudinal reference axis, and wherein, said second side wall member and portions of said first side wall member being generally aligned with said longitudinal reference axis and spaced apart to permit a pair of skis to lie on said container floor member in side-by-side arrangement substantially in parallel with said reference axis with said curved ski tip ends of said pair of skis proximate to said forward wall member and extending away from said container floor member, and said first side wall member includes a plurality of first side wall member portions for establishing a second chamber in communication with said longitudinal chamber and in which said second chamber extends generally perpendicular to said longitudinal reference axis and having a floor member generally formed, at least in part by said container floor member, said second chamber protruding away from said longitudinal axis at a selected position between said forward and rearward wall members, and in which said second chamber is configured and arranged to accommodate toe portions of a pair of ski boots positioned in said first and second chambers with said pair of skis being between said container floor member and said pair of ski boots, and said pair of ski boots being in a mirror-like sole-to-sole and heel-to-heel position adjacency, and which the soles are generally perpendicular to said reference axis and said container floor member, and in which the heel portions of said pair of ski boots are bounded by and proximate to said second side wall member, and in which said leg cuff end of one of said pair of ski boots is proximate to said forward wall end member, and said container including contiguous peripheral container edge portions defining said open enclosure;

a first cover member integral with portions of said first and second side wall members and said rearward wall member, extending toward said forward wall member so as to form a first rearward pocket so as to be capable of covering, at least in part, rearward ski ends of said pair of skis when positioned within said transport and storage case; and a hinged cover having opposite top and bottom sides, said bottom side including peripheral bottom edge portions configured such that said peripheral bottom edge portions may be placed in mating relationship with said contiguous peripheral container edge portions, with said cover further configured such that said equipment container and said cover form a protected closed enclosure for said set of ski equipment.

20. The transport and storage case of claim 19 further comprising a second cover member integral with portions of selected ones of said plurality of first side wall member portions establishing said second chamber and extending over, at least in part, said second chamber so as to form a boot-toe pocket so as to be capable of covering, at least in part, said toe portions of said pair of ski boots when positioned within said transport and storage case.

* * * * *